US006218672B1

(12) United States Patent
Alig

(10) Patent No.: US 6,218,672 B1
(45) Date of Patent: Apr. 17, 2001

(54) ION SOURCE

(75) Inventor: Roger Casanova Alig, Princeton Jct., NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/163,635

(22) Filed: Sep. 30, 1998

Related U.S. Application Data

(60) Provisional application No. 60/093,971, filed on Jul. 24, 1998.

(51) Int. Cl.[7] ..... H01J 27/00
(52) U.S. Cl. ..... 250/427; 250/423 R
(58) Field of Search ..... 250/423, 281, 250/427, 282; 204/192.16

(56) References Cited

U.S. PATENT DOCUMENTS 3,731,089 * 5/1973 Elliott ..... 250/41.9 SB
4,159,423 * 6/1979 Kambara ..... 250/423
5,101,105 * 3/1992 Fenselau et al. ..... 250/281

* cited by examiner

*Primary Examiner*—Teresa M. Arroyo
*Assistant Examiner*—Johnnie Smith, II
(74) *Attorney, Agent, or Firm*—William J. Burke; Abhik A. Huq

(57) ABSTRACT

An ion source including an electron generating chamber and an ionization chamber adjacent the electron generating chamber and having an opening therebetween. The ionization chamber has a gas inlet opening and the electron generating chamber has a outlet. The gas inlet opening, the outlet and the opening between the two chambers are all on a common axis. The electron generating chamber has therein a cathode filament which extends completely around the axis and generates electrons, electrodes for directing the electrons transversely toward the axis and a deflection electrode for deflecting the electron flow along the axis and into the ionization chamber. An accelerator plate is adjacent the outlet and is adapted to attract ions generated in the ionization chamber along the axis and through the outlet.

13 Claims, 3 Drawing Sheets

ION SOURCE

This application claims the benefit of U.S. Provisional Application Ser. No. 60/093,971 Filed Jul. 24, 1998.

This invention was made with U.S. government support under contract number S-97526-Z with the National Aeronautics and Space Administration. The U.S. government has certain rights in this invention.

FIELD OF THE INVENTION

The present invention relations to an ion source, and more particularly to a device which generates ions using a beam of generated electrons.

BACKGROUND

An ion source utilizes an electron gun to generate electrons, which ionize neutral atoms and molecules. There are various apparatus, such as a mass spectrometer, which require an ion source. In a mass spectrometer, the ion source is used to ionize a gas which consists of neutral particles so that the ions of the gas can be analyzed. The electron-ionization source which has been generally used for mass spectrometers is the Nier source. Referring to FIGS. 1 and 2 there is shown diagrams of two views of a typical Nier source 10. The Nier source 10 comprises a chamber 12 having a front wall 14 and a back wall 16. A gas inlet passage 18 extends through the back wall 16 to allow a gas to be ionized to enter the chamber 12. An exit slit 20 is in the front wall 14 of the chamber 12. An electron source filament 22 is in the chamber adjacent the side wall 24 of the chamber 12. The filament 20 is connected to a source of electricity (not shown) for heating the filament 20. An accelerator plate 26 is adjacent but spaced from the outer surface of the front wall 14 of the chamber 12. The accelerator plate 26 has a slit 28 therethrough which is aligned with the exit slit 20 in the front wall 14 of the chamber 12.

In the operation of the Nier ion source 10, a gas of the sample material passes through the gas inlet passage 18 into the chamber 12. The filament 20 is heated so as to emit electrons. The electrons from the filament 20 pass transversely across the chamber 12 and across the flow of the gas. The electrons bombard the gas so that ions are generated by the electron impact. These ions are drawn through the exit slit 20 in the front wall 14 of the chamber 12 by the accelerator plate 26. The ions then pass through the slit 28 in the accelerator plate 26 and flow into a mass spectrometer (not shown). In the Nier ion source 10, ionization takes place only in the area of the gas which is traversed by the electron beam so that the amount of ions generated is relatively small. Also, the ions are generated only over an area defined by the length and width of the exit slit 20. These ions must then be focused onto the entrance of a quadrupole mass spectrometer, which is typically a small circular aperture. Therefore, additional focusing plates are required to ensure that all of the ions generated enter the mass spectrometer.

SUMMARY OF THE INVENTION

An ion source includes an electron generating chamber and a ionization chamber adjacent the electron generating chamber. A gas inlet opens into the ionization chamber and an opening extends between the ionization chamber and the electron generating chamber. The electron generating chamber has an outlet opening therein. The gas inlet, opening between the ionization chamber and electron generating chamber and the outlet opening are all along a common axis. The electron generating chamber has therein means for generating electrons completely around the axis and means for directing the electrons radially toward the axis. Also in the electron generating chamber is means for deflecting the radial flow of electrons longitudinally along the axis and into the ionization chamber. At the outlet opening is means for attracting the ions toward and through the outlet opening.

DETAILED DESCRIPTION

Figure 1:
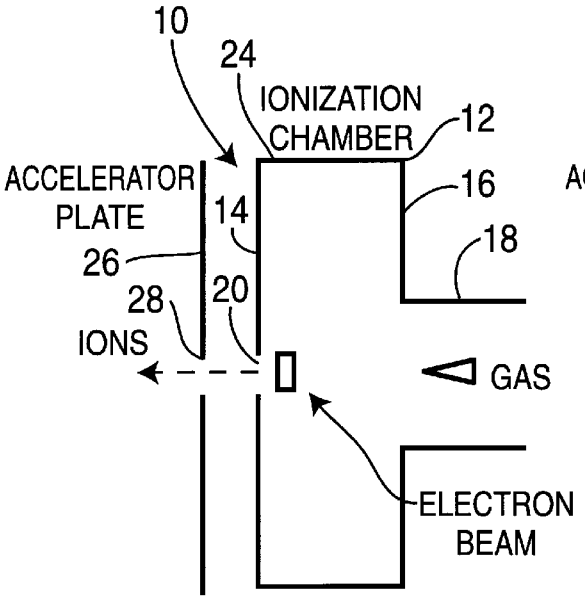
FIG. 1 PRIOR ART
FIG. 1 is an end view of a diagram of a prior art Nier ion source.
Figure 2:
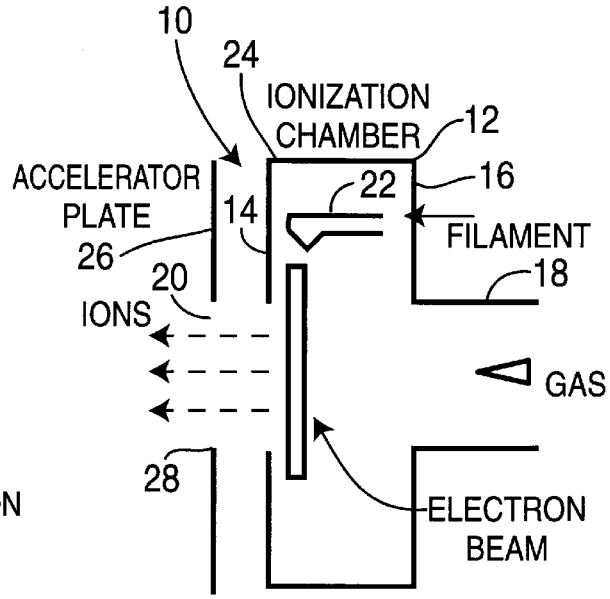
FIG. 2 PRIOR ART
FIG. 2 is a side view of the Nier ion source shown in FIG. 1.
Figure 3:
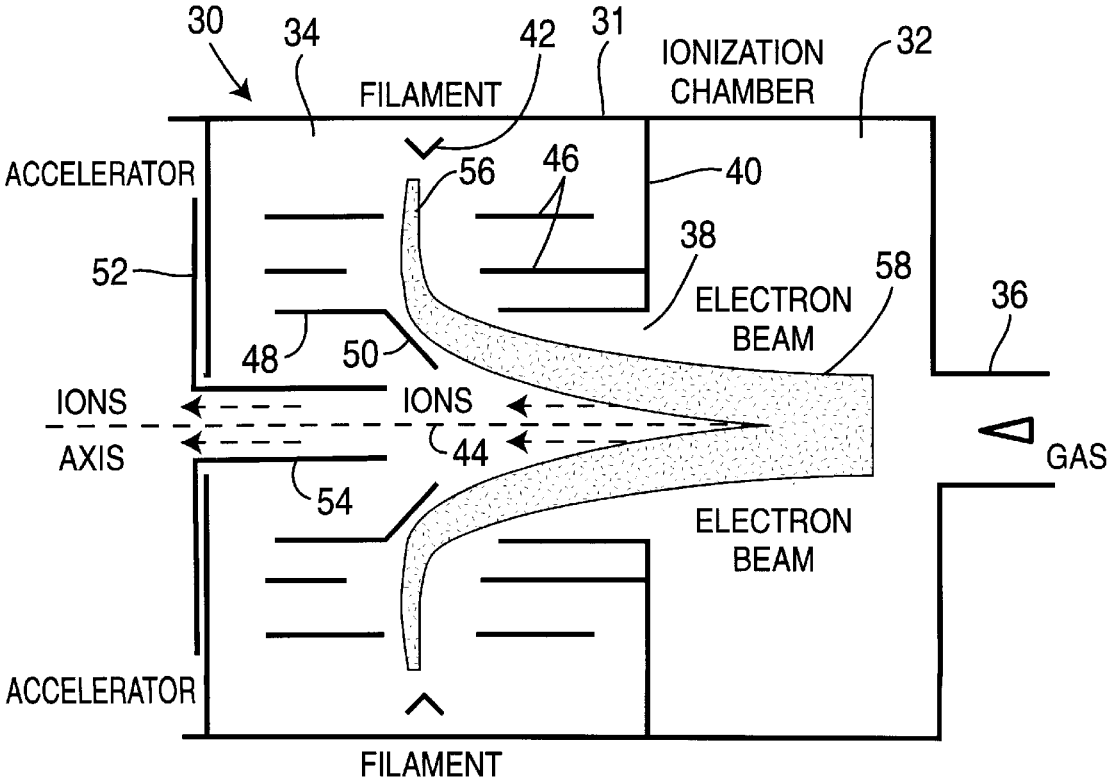
FIG. 3 is a schematic view of an ion source of the present invention.

Referring initially to FIG. 3, there is schematically shown a ion source 30 in accordance with the present invention. Ion source 30 comprises a housing 31 having therein an ionization chamber 32 and an electron generating chamber 34 adjacent the ionization chamber 32. A gas inlet tube 36 extends into the ionization chamber 32 at its side opposite the electron generating chamber 34. The ionization chamber 32 has an opening 38 in its wall 40 adjacent the electron generating chamber 34.

In the electron generating chamber 34 is a cathode filament 42 which extends completely around the electron generating chamber 34 so that the filament 42 extends completely around an axis 44 which extends longitudinally along the center of the opening 38. Electrodes 46 are in the electron generating chamber 34 between the filament 42 and the axis 44 to guide electrons from the filament 42 across the electron generating chamber 34 transversely to the axis 44. A deflection electrode 48 is within the electron generating chamber, within the electrodes 46, and around the axis 44. The deflection electrode 48 has a conical deflection plate 50 facing the opening 38 in the wall 40 of the ionization chamber 32. An accelerator electrode 52 is on the side of the electron generating chamber 34 opposite the ionization chamber 32. The accelerator electrode 52 has a tubular portion 54 which extends within the deflection electrode 48 and around the axis 44.

In the operation of the ion source 30, a current is provided through the cathode filament 42 to generate electrons. The electrodes 46 generate an electric field which causes the electrons to flow as a beam 56 radially toward the axis 44 of the electron generating chamber. The deflection electrode 48 generates an electric field which causes the beam 56 to be deflected along the axis 44 into the ionization chamber 32. Thus, there is provided an electron beam 58 which extends longitudinally along the axis 44 and into the flow of gas entering the ionization chamber 32 through the inlet tube 36. The electrons impinge on the gas causing the generation of ions of the material forming the gas. The ions are drawn along the axis 44 into the electron generating chamber 34 and then through to cylindrical portion 54 of the accelerator plate 50 into a device (not shown) for using or analyzing the ions. The charge of the electrons helps draw the ions from the ionization chamber 32 into the electron generating chamber 34 and the charge on the accelerator plate 50 draws the flow of ions the rest of the way.

Figure 4:
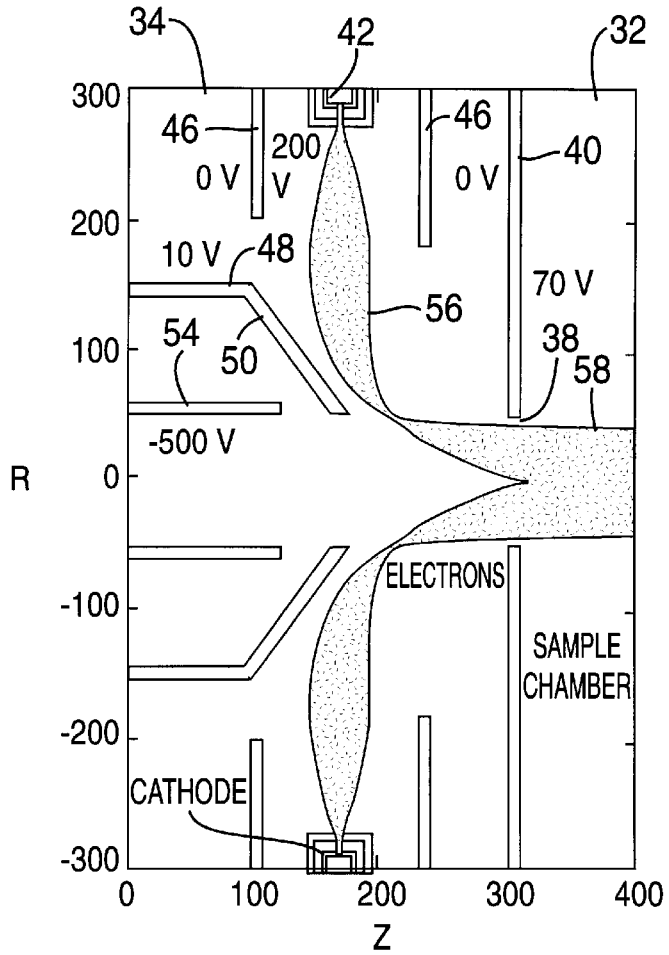
FIG. 4 is a schematic view of the ion generating chamber of the ion source of the present invention showing the trajectory of the electrons.
Figure 5:
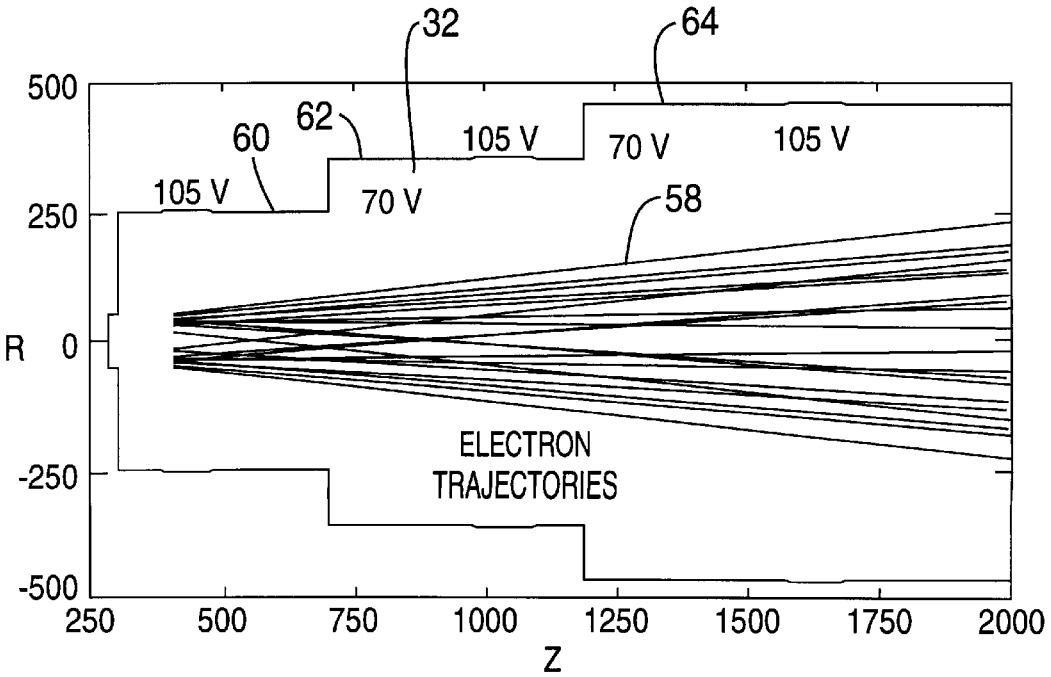
FIG. 5 is a schematic view showing the electron trajectories in the ionization chamber of the ion source of the present invention.

The transverse beam of electrons 56 and the longitudinal beam of electrons 58 is achieved by the size of the electrodes 46 and 50 and the voltage applied thereto. FIG. 4 is a sectional view of the electron generating chamber 32 showing typical arrangement and size of the electrodes 46 and 50 as well as typical voltages applied to the electrodes to achieve the desired beam of the electrons. Although the dimensions shown in FIG. 4 can be of any dimension, they would typically be in mils. Also, it is desirable that the longitudinal beam of electrons 58 be as collimated as possible. FIG. 5 is a diagram of a typical ionization chamber 32 which can achieve improved collimation of the beam 58. The ionization chamber 32 is formed of three cylindrical sections 60, 62 and 64 of different diameters. The section 60 is of the smallest diameter and is adjacent the electron generating chamber 34. The section 62 is the next largest section and the section 64 is the largest section. The outer wall of each of the sections are at the same voltage whereas the radial walls connecting the sections are at a lower voltage. The dimensions of the ionization chamber 32 and the voltages applied to the various portions of the ionization chamber 32 shown in FIG. 5 will collimate the electron beam 58.

Figure 6:
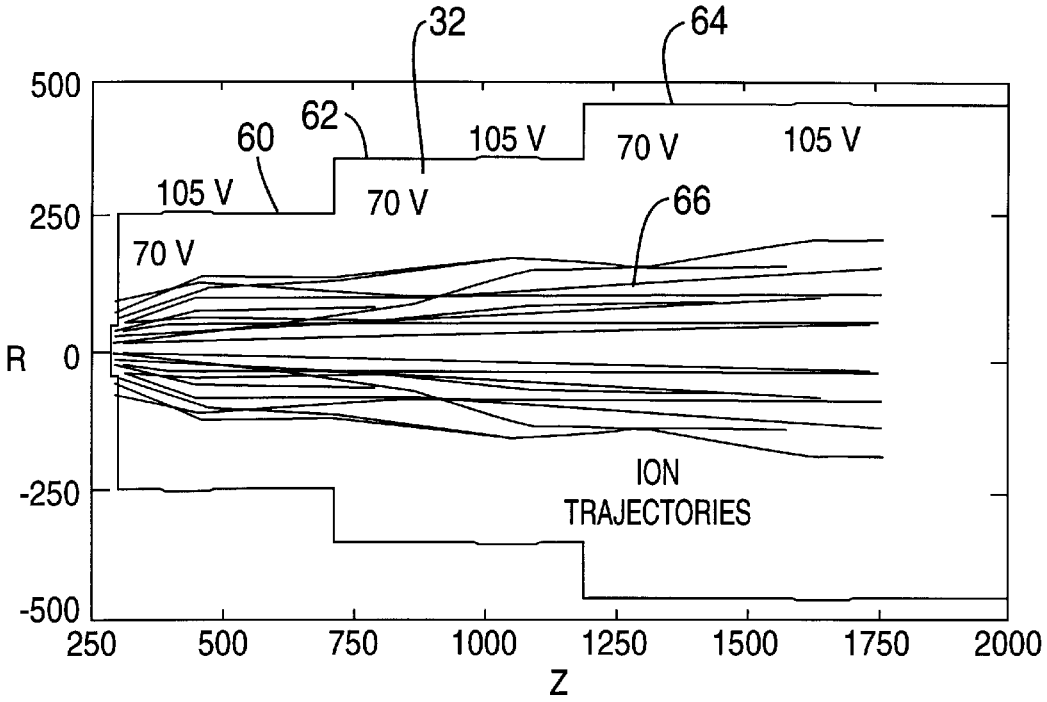
FIG. 6 is a schematic view showing the ion trajectories in the ionization chamber of the ion source of the present invention.
Figure 7:
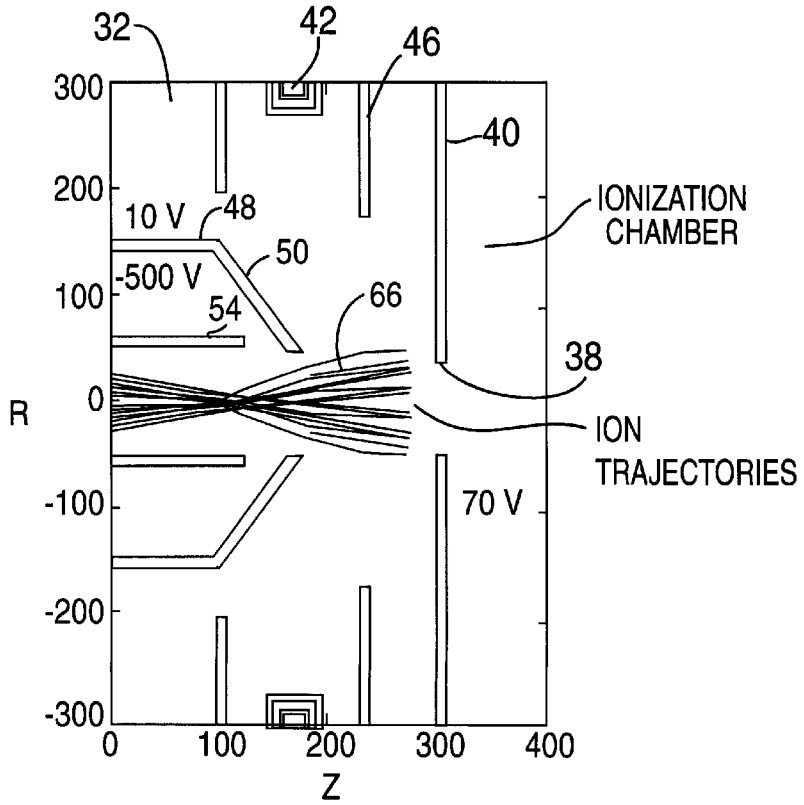
FIG. 7 is a schematic view showing the ion trajectories in the electron generating chamber of the ion source of the present invention.

Referring to FIG. 6 there is shown trajectories of the beam of ions 66 generated in the ionization chamber 32 of the structure shown in FIG. 5. This generated beam of ions 66 is drawn out of the ionization chamber 32 into the electron generating chamber 34 as previously described. Referring to FIG. 7 there is shown the trajectories of the beam of ions 66 through the electron generating chamber 34. This FIG. also shows a typical voltage which is applied to the cylindrical portion 54 of the accelerator electrode 52 to achieve a flow of the ions out of the electron generating chamber 34 and into the adjacent device. This voltage also forms the beam of ions 66 into a cylindrical beam of relatively small diameter.

In the ion source 30 of the present invention, the generated electrons in the electron generating chamber 34 do not just flow transversely across the flow of the gas, but is deflected to flow as a beam longitudinally along the axis along which the gas flows. This results in a much longer contact between the electrons and the gas so that a larger number of ions is generated. Thus there is provided a larger signal to noise ratio. In addition, the generated ions are formed into a cylindrical beam of relatively small diameter so that it can more easily pass through a cylindrical opening into the device which is to either use or analyze the ions. Thus there is a smaller loss of ions from the ion source into the device which is to use or analyze the ions. Thus, there is provided by the present invention an ion source which provides a larger number of generated ions and which provides a cylindrical beam of the generated ions for a small loss of ions from the ion source to the device which either uses or analyzes the ions.

What is claimed is:

1. An ion source comprising:

an electron generating chamber;

an ionization chamber adjacent the electron generating chamber;

an opening between the ionization chamber and the electron generating chamber;

a gas inlet into the ionization chamber;

an outlet from the electron generating chamber;

the gas inlet, opening between the ionization chamber and the electron generating chamber, and the outlet all being along a common axis;

means in the electron generating chamber for generating electrons completely around the said axis;

means in the electron generating chamber for directing the electrons toward said axis;

means in the electron generating chamber for deflecting the flow of electrons to flow along said axis into the ionization chamber; and means at said outlet for attracting the generated ions toward and through said outlet.

2. The ion source of claim 1 in which the means in the electron generating chamber for directing the electrons toward the axis comprises electrodes.

3. The ion source of claim 1 in which the means for attracting the ions comprises an accelerator plate extending transversely to said axis adjacent the outlet.

4. The ion source of claim 1 in which the means for generating the electrons comprises a cathode filament in the electron generating chamber and extending completely around the said axis.

5. The ion source of claim 1 in which the ionization chamber comprises three sections of different diameters.

6. The ion source of claim 2 in which the means in the electron generating chamber for deflecting the electrons comprises an electrode extending around said axis and having a conical portion at its end adjacent the path of the electrons transverse to the axis and facing the opening between the electron generating chamber and the ionization chamber.

7. The ion source of claim 3 in which the accelerator plate has a cylindrical portion extending around said axis and into the electron generating chamber.

8. The ion source of claim 5 in which the sections of the ionization chamber increase in diameter along the length of the ionization chamber with the section of smallest diameter being adjacent the electron generating chamber.

9. An ion source comprising:

an electron generating chamber;

an ionization chamber adjacent the electron generating chamber;

an opening between the ionization chamber and the electron generating chamber;

a gas inlet into the ionization chamber;

an outlet from the electron generating chamber;

the gas inlet, opening between the ionization chamber and the electron generating chamber, and the outlet all being along a common axis;

a cathode filament in the electron generating chamber and extending completely around the said axis, said filament being capable of generating electrons;

electrodes in the electron generating chamber for directing the generated electrons toward said axis;

an electrode in said electron generating chamber and extending around said axis for deflecting the flow of electrons from the cathode along said axis into the ionization chamber; and an accelerator plate extending transversely to said axis adjacent the outlet for attracting generated ions toward said outlet.

10. The ion source of claim 9 in which the electrode for deflecting the flow of electrons a conical portion at its end adjacent the path of the electrons toward said axis and facing the opening between the electron generating chamber and the ionization chamber.

11. The ion source of claim 10 in which the accelerator plate has a cylindrical portion extending around said axis and into the electron generating chamber.

12. The ion source of claim 11 in which the ionization chamber comprises three section of different diameters.

13. The ion source of claim 12 in which the sections of the ionization chamber increase in diameter along the length of the ionization chamber with the section of smallest diameter being adjacent the electron generating chamber.

* * * * *